United States Patent [19]

Gilbride et al.

[11] 4,292,907

[45] Oct. 6, 1981

[54] PRESSER-FOOT APPARATUS

[75] Inventors: Andrew J. Gilbride, Swampscott; Francis A. Wickers, Beverly, both of Mass.

[73] Assignee: USM Corporation, Farmington, Conn.

[21] Appl. No.: 53,021

[22] Filed: Jun. 28, 1979

[51] Int. Cl.[3] ..... D05B 29/00; D05C 9/02

[52] U.S. Cl. ..... 112/236

[58] Field of Search ..... 112/235, 236, 237, 238, 112/239, 78, 121, DIG. 2, DIG. 3; 173/139

[56] References Cited

U.S. PATENT DOCUMENTS

| | | | |
|---|---|---|---|
| 1,714,021 | 5/1929 | Gury | 112/235 |
| 2,386,840 | 10/1945 | Colegrove | 112/236 |
| 2,633,093 | 3/1953 | Russell | 112/236 |
| 3,026,837 | 3/1962 | Enos | 112/236 |
| 3,244,241 | 4/1966 | Ferwerda | 173/139 |
| 3,282,237 | 11/1966 | Niekrawietz | 112/236 |
| 3,538,872 | 1/1969 | Pell | 112/239 |
| 3,759,202 | 9/1973 | Jean-Blanc | 112/239 |
| 4,060,045 | 11/1977 | Vahle et al. | 112/235 |

*Primary Examiner*—Werner H. Schroeder
*Assistant Examiner*—Andrew M. Falik
*Attorney, Agent, or Firm*—William F. White

[57] ABSTRACT

Presser-foot apparatus is disclosed which is capable of automatically adjusting to various levels of sewing. The presser-foot is slidably held within a housing affixed to a needle bar. The presser-foot is biased against the housing so as to move in conjunction therewith until contact is made with the workpiece. The presser-foot exerts a steady, unvarying pressure on the workpiece while the needle associated therewith continues downwardly. The presser-foot is ultimately lifted from the workpiece during the upward retraction of the needle from the workpiece.

20 Claims, 6 Drawing Figures

PRESSER-FOOT APPARATUS

FIELD OF THE INVENTION

This invention relates to a functional element commonly found in nearly all sewing machines, namely, a presser-foot. In particular, this invention relates to presser-foot apparatus which is self-adjustable for variable thicknesses and multiple layers of work.

BACKGROUND OF THE INVENTION

Apparatus which press against a workpiece that is to be sewn are generally known as presser-foot devices. These devices perform the function of preventing the material that is being sewn from lifting when the needle is being withdrawn from the workpiece. This tendency of the workpiece to lift with the needle will otherwise cause flagging and hence improper stitching.

Conventional presser-foot devices have for the most part been driven by various eccentric arrangements which move the presser-foot downwardly toward the workpiece in a timely fashion. This downward travel is usually limited to a pre-set height above the bed of the sewing machine. This pre-set height usually allows the presser-foot to move relatively close to a workpiece having a uniform thickness of one or more materials to be sewn. This close relationship of the presser-foot to the workpiece is maintained throughout the sewing period as long as the thickness does not vary appreciably.

Workpieces consisting of multiple layers of material usually present a problem for presser-feet having pre-set height limitations. A compromised setting must be used for sewing the different layers of these workpieces. Such a setting will result in the presser-foot making contact with the top layer of a two layer workpiece and substantially clearing the bottom layer. This compromised setting may or may not be sufficient to prevent flagging and hence improper stitching. The solution to this problem is often to lower the sewing speed which reduces the overall productivity of the machine. When the variable thickness of the workpiece exceeds two levels of thickness, a compromised setting is even less practical.

The problem encountered with sewing at various levels has been somewhat remedied by self-adjusting presser-foot devices. These devices are capable of adjusting to the different thicknesses of a workpiece so as to always maintain contact therewith. These devices vary as to their success in achieving a satisfactory pressurized contact. These devices are furthermore often complex and susceptible to extreme wear of their various parts. These complex mechanisms furthermore often dictate that the presser-foot must maintain a relationship relative to the needle which does not allow for an easy threading of the needle.

OBJECT OF THE INVENTION

It is an object of this invention to provide a new and improved presser-foot apparatus which allows multilevel work to be successfully stitched at high speeds.

It is another object of this invention to provide a new and improved presser-foot apparatus which produces substantially steady contact pressure with the work that is being sewn.

It is a still further object of this invention to provide a new and improved presser-foot apparatus which permits a normal threading of the needle.

It is an even further object of this invention to provide a presser-foot apparatus which adjusts to the level of work being sewn with a minimum amount of mechanical complexity.

SUMMARY OF THE INVENTION

The above and other objects are achieved according to the present invention by providing a spring biased presser-foot which is operatively coupled to a needle bar shaft. The spring biasing is accomplished by a helical spring fixed at one end to a stationary member that does not move relative to the reciprocating needle bar shaft. The opposite end of the helical spring is biased against a column extending above the presser-foot. The column is slidably supported within a housing that is affixed to the needle bar shaft. The presser-foot normally moves with the needle bar shaft in a downward manner until such time as contact is established with a workpiece. The needle bar shaft and the housing affixed thereto continue to travel downward while the presser-foot remains pressed against the workpiece. The pressure exerted by the presser-foot on the workpiece is maintained at a steady state value while the needle bar shaft completes its downward movement and again moves upward to a point wherein the needle is withdrawn from the workpiece. At this time, the housing affixed to the needle bar shaft catches the top of the column extending above the presser-foot and lifts the same off the workpiece.

In accordance with the invention, provision is also made for withdrawing the spring biased presser-foot to a position which allows for the threading of the needle. The normal position of the presser-foot relative to the sewing needle is established upon the next cycle of needle bar movement.

In accordance with yet another aspect of the present invention, an alternative embodiment is disclosed wherein the helical spring biasing is replaced by a pressurized air cylinder. The pressurized air cylinder forms the requisite spring action for the presser-foot.

BRIEF DESCRIPTION OF THE DRAWINGS

The above and other features of the present invention will now be particularly described with reference to the accompanying drawings, in which.

DESCRIPTION OF THE PREFERRED EMBODIMENT

Figure 1:
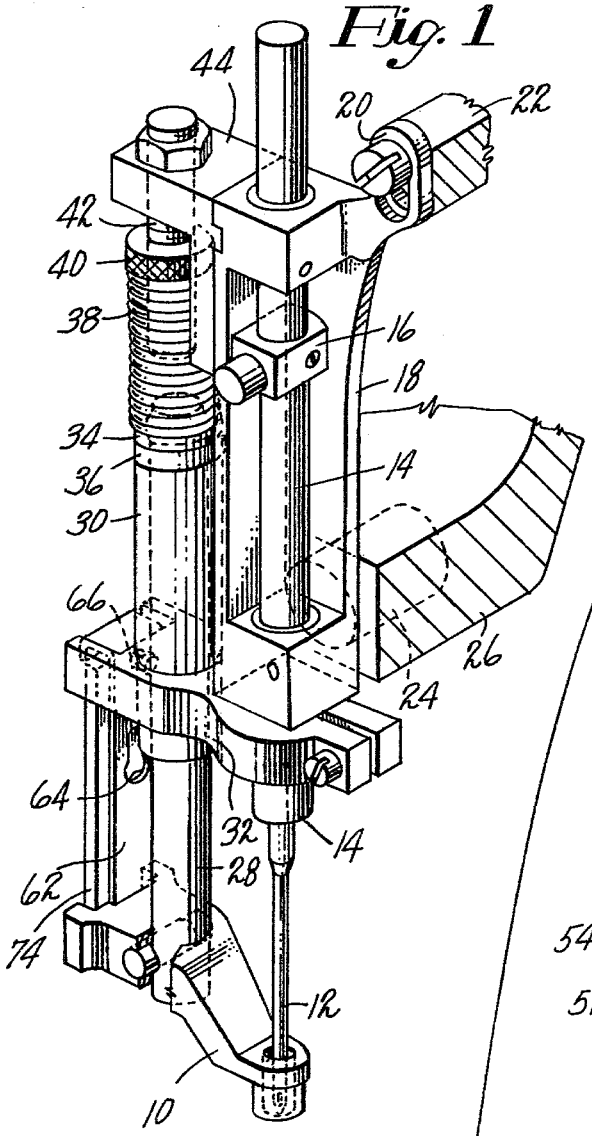
FIG. 1 is a perspective view of the presser-foot apparatus of the present invention.

Referring to FIG. 1, a presser-foot 10 is generally illustrated relative to a sewing needle 12. The needle 12 is connected to a needle bar 14 which is driven via a drive connection 16 in a conventional manner. The needle bar reciprocates within a stationary guide member 18 which is physically attached to the frame of a sewing machine that is only partially shown. The attachment is in the form of a screw 20 which secures the stationary guide member 18 to a portion of an upper-frame member 22. The lower portion of the guide member 18 is maintained in position by a blind pin 24 which extends into a portion of a lower-frame member 26 of the sewing machine. It is to be appreciated that the stationary guide member 18 could merely be part of the sewing machine frame itself without departing from the scope of the invention.

Referring again to the presser-foot 10, it is seen that the same is attached to a cylindrical shaft 28 which extends upwardly into a cylindrical housing 30. The housing 30 includes a support base 32 which attaches to the needle bar 14. This attachment allows the housing 30 to move up and down with the needle bar 14. It is to be noted that the shaft 28 extends completely through the cylindrical housing 30 and terminates in a top end 34. The top end 34 is separated from the housing 30 by a hard rubber ring 36.

Figure 2:
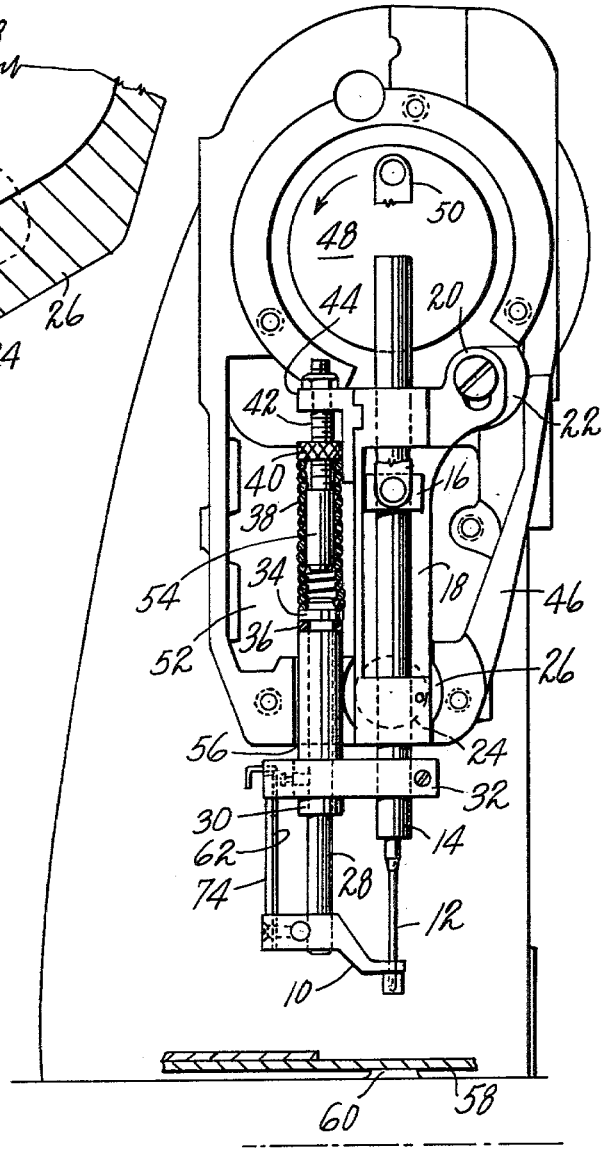
FIG. 2 is a front view of a sewing machine incorporating the presser-foot apparatus of FIG. 1.

Referring to FIG. 2, the presser-foot apparatus is illustrated within the front portion of a sewing head 46. The sewing head is part of a conventional sewing machine wherein the needle 12 is driven in a conventional manner. Specifically, an eccentric drive 48 located at the top of the sewing head 46 is operative to move a drive link 50 which in turn transmits vertical movement to the drive connection 16 located on the needle bar. This in turn causes the needle bar 14 to move in a normal fashion.

Provision is made within the sewing head 46 for accomodating the various parts of the presser-foot apparatus. In particular, this includes a spacial cavity 52 which accomodates the various parts of the presser-foot apparatus as shown. This includes the top member 44 which extends outwardly into the cavity 52 from the guide member 18. As has been previously discussed, the adjusting nut 40 and the threaded bolt 42 depend from the top member 44 so as to define a fixed top reference point for the helical spring 38. The helical spring 38 is maintained in a vertical position below this top reference point by a downwardly extending cylindrical member 54 which forms part of the lower threaded shaft 42. The downwardly extending cylindrical member 54 is sufficiently downstream of the threaded portion of the shaft 42 so as to allow for appropriate biasing adjustments by the adjustment nut 40. Referring now to the bottom portion of the presser-foot apparatus and in particular to the housing 30, it is seen that the same extends upwardly through an annular opening 56. The annular opening 56 allows the housing 30 to freely move up and down.

The overall operation of the presser-foot apparatus within the sewing head 46 will now be described in terms of an overall sewing cycle. In operation, the needle bar 14 is driven downwardly by the drive link 50 which is pivotally connected to both the drive connection 16 and the eccentric drive 48 of the sewing machine. This causes the cylindrical housing 30 to move downwardly by virtue of its base 32 being affixed to the needle bar 14. The helical spring 38 maintains the top end 34 of the shaft 28 against the hard rubber ring 36 which in turn presses against the cylindrical housing 30. This causes the presser-foot 10 to move downwardly with the cylindrical housing 30. This downward movement of the presser-foot 10 continues to occur until the toe of the presser-foot 10 contacts a workpiece 58. At this time, the presser-foot 10 and the shaft 28 extending thereabove ceases to move downwardly. On the other hand, the housing 30 continues to move downwardly with the needle bar 14. This produces relative downward movement of the housing 30 along the length of the shaft 28. This relative downward movement continues to occur as the needle 12 moves downwardly through the workpiece 58.

Figure 3:
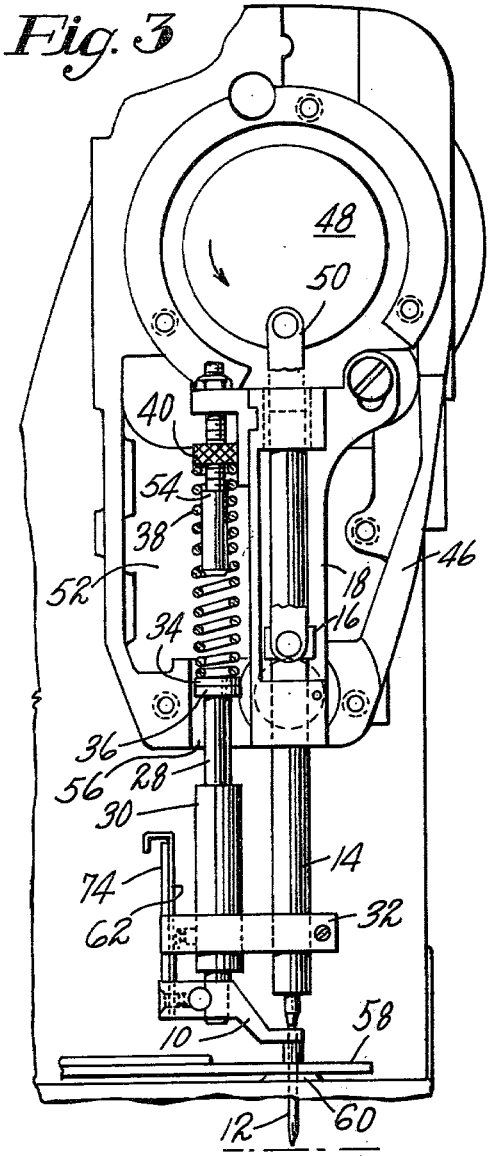
FIG. 3 illustrates an operative position of the presser-foot relative to a workpiece that is to be sewn.

Referring to FIG. 3, the needle 12 is seen to have moved through the workpiece 58 and hence through a throat plate 60. The housing 30 connected to the needle bar 14 has moved down the shaft 28 as illustrated. This relative movement of the housing 30 has allowed the presser-foot 10 to maintain a steady pressure dictated by the non-varying length of the helical spring 38 after contact with the workpiece.

As illustrated in FIG. 3, the needle 12 has reached its furthest point of downward travel. The needle 12 now begins to move upwardly while the workpiece 58 is maintained against the throat 60 by virtue of the steady unvarying pressure exerted by the presser-foot 10. This continues to occur until the needle is actually withdrawn from the workpiece whereupon the housing 30 again makes contact with the shock absorbent ring 36 and begins to lift the presser-foot 10 off the workpiece. The workpiece 58 is now free to be repositioned for the next subsequent stitch which will take place during the next sewing cycle. The repositioned workpiece may in fact produce a different thickness of material to be sewn. This will merely result in a different level of contact being experienced by the presser-foot 10. The presser-foot 10 will again produce a steady downward pressure at this level while the needle proceeds through the workpiece.

Figure 4:
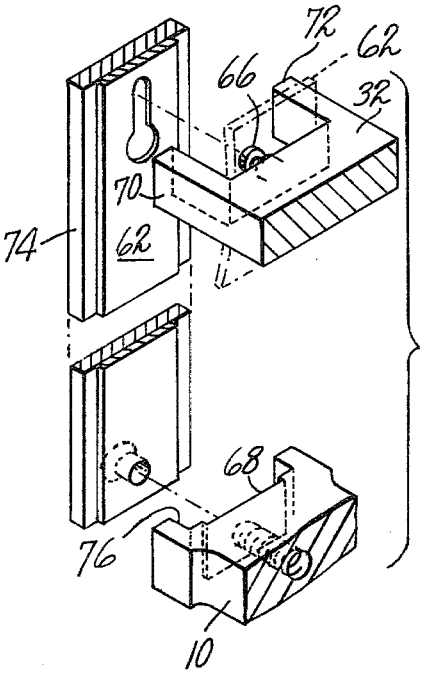
FIG. 4 is an exploded view of certain parts of the presser-foot apparatus which allow the sewing needle to be threaded.

As can be appreciated, the presser-foot 10 is normally maintained at the end of the needle 12 when the needle is not in the workpiece. This allows for an initial contact of the presser-foot with the workpiece prior to any needle penetration. Provision has however been made to withdraw the presser-foot 10 relative to the needle 12 so as to allow for the threading of the needle. Referring to FIG. 1, a cantilevered leaf-spring 62 is attached to the heel of the presser-foot 10. The leaf-spring 62 contains a keyhole 64 which will engage a pin 66 on the base 32. The pin 66 is not actually visible in FIG. 1, but can be readily seen in FIG. 4. FIG. 4 additionally illustrates the relative position of the leaf-spring 62 to both the heel of the presser-foot 10 as well as the rearward portion of the base 32. The leaf-spring 62 is seen to fit into a recess 68 within the heel of the presser-foot 10. The leaf-spring 62 extends upwardly into an opening between a pair of prongs 70 and 72 in the rearward portion of the base connection 32. The pin 66 is located between the prongs 70 and 72 as shown.

Figure 5:
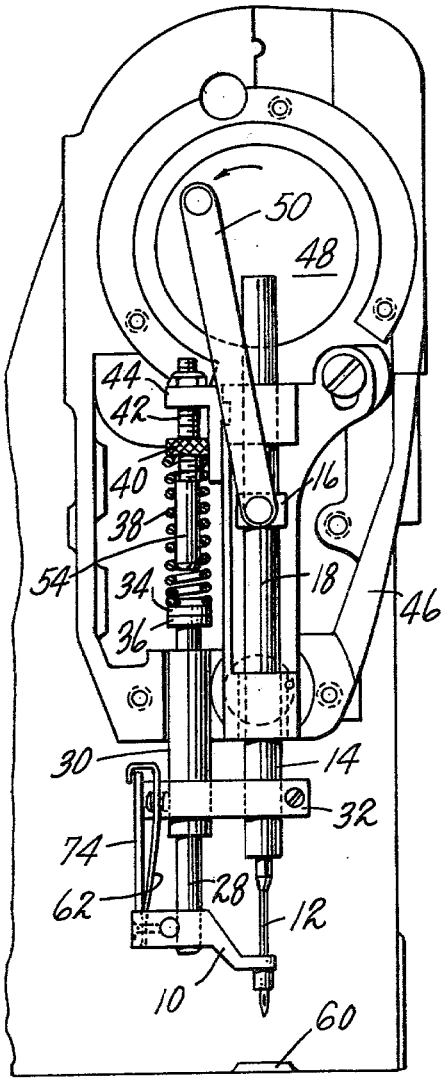
FIG. 5 illustrates the position of the presser-foot which allows for the threading of the sewing needle.

The manner in which the presser-foot 10 is repositioned relative to the needle will now be described. The presser-foot 10 is manually raised against the downward pressure exerted by the helical spring 38 until the circular hole of the keyhole 64 is opposite the pin 66. At this point, the leaf-spring 62 is physically pushed towards the base 32 so as to cause the circular hole to move over the head of the pin 66. The presser-foot 10 is now allowed to move slightly downward so as to allow the slot portion of the keyhole 64 to move down behind the head of the pin 66. At this point, the presser-foot 10 will be held above the end of the needle 12 so as to allow for threading. This is clearly shown in FIG. 5.

The presser-foot 10 will subsequently be returned to its normal position relative to the sewing needle during the next sewing cycle. Specifically, the presser-foot 10 will contact the workpiece on the next sewing cycle causing the leaf-spring 62 to no longer move with the cylindrical housing 30. At this time, the pin 66 will begin to move down the slot of the keyhole 64 until the head of the pin is in the circular hole portion. At this time, the leaf-spring 62 will spring loose so as to thereby move free of the pin 66.

It is to be noted that the position of the presser-foot 10 could also be repositioned relative to the end of the needle 12 by manually moving the presser-foot upwardly. The leaf-spring 62 would merely move away at such time as the circular hole portion of the keyhole 64 is opposite the head of the pin 66.

Referring again to FIG. 4, a guide 74 also fits into a second and larger recess 76 within the heel of the presser-foot 10. The width of the guide 74 is substantially the same as the distance between the prongs 70 and 72 of the rearward portion of the base connection 32. This allows for the guide 76 to freely move up and down between the prongs 70 and 72. This guiding of heel of the presser-foot 10 assures that the presser-foot will not rotate relative to the needle 12.

Figure 6:
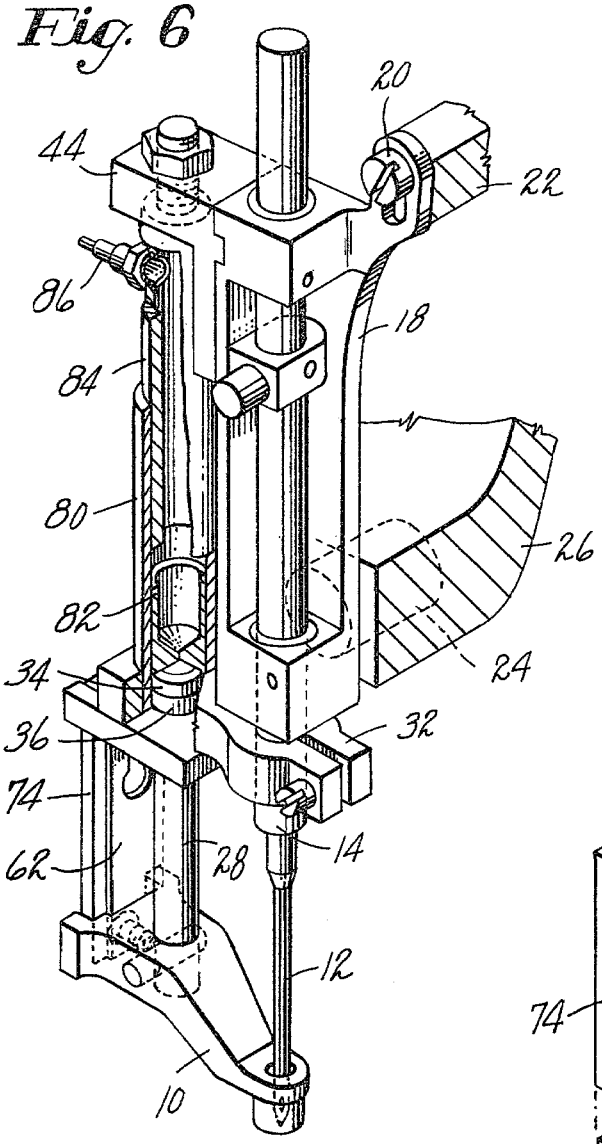
FIG. 6 illustrates an alternative embodiment to the presser-foot apparatus of FIG. 1.

Referring now to FIG. 6, an alternative to the helical spring 38 of FIG. 1 is illustrated. In particular, the helical spring 38 has been replaced by a pressurized chamber. The pressurized chamber comprises a bottom vessel 80 which is physically attached to the base 32. An inner hollow cylinder 82 attaches to the top 34 of the shaft 28 and slidably engages the inner wall of the bottom vessel 80. The inner hollow cylinder 82 will normally be maintained at the extreme bottom of the pressurized chamber so as to thereby bias the hard rubber ring 36 against the base 32. The bottom vessel 80 will however move relative to the inner hollow cylinder 82 when relative movement occurs between the shaft 28 and the base 32. As has been previously discussed, this occurs upon contact of the presser-foot 10 with a workpiece. The pressurized chamber furthermore comprises a top vessel 84 which is affixed to the member 44. The outer wall of the top vessel 84 slidably engages the inner wall of the lower vessel 80. This allows for the relative movement of the lower vessel 80 with respect to the top vessel 84. This latter movement occurs as a result of the needle bar 14 moving relative to the needle bar guide 18. The top vessel 84 contains a pneumatic valve fitting 86 which provides for an appropriate pneumatic pressure to be built up in the pressurized chamber comprising the vessels 80 and 84. The thus built up pressure is such as to define an appropriate spring constant similar to that of the helical spring 38. This pressure will allow the presser-foot to produce the steady non-varying contact pressure on the workpiece after contact therewith.

The thus pressurized chamber can be easily depressurized by appropriate control of a valve upstream of the valve fitting 86. This would allow for a lessening of the spring constant experienced when manually moving the presser-foot upwardly so as to thread the needle. This would furthermore allow for adjustably defining the biasing pressure for various sewing conditions.

From the foregoing, it is to be appreciated that a preferred embodiment and an alternative thereto have been disclosed for a presser-foot apparatus. It is to be appreciated that alternative structure may be substituted for various elements of these embodiments without departing from the scope of the present invention.

What is claimed is:

1. In a sewing machine having at least one reciprocating needle bar, apparatus for maintaining the workpiece in a proper position during sewing, said apparatus comprising:

a presser-foot assembly including a presser-foot;

means, affixed to said needle bar, for slidably holding said presser-foot assembly;

means for biasing said presser-foot assembly initially against said slidably holding means until said presser-foot contacts the workpiece whereupon said biasing means exerts a steady pressure on the workpiece said biasing means being mounted to a stationary point which does not move in conjunction with the movement of said needle bar so as to thereby exert the steady pressure on the workpiece.

2. The apparatus of claim 1 wherein said presser-foot assembly comprises:

a shaft connected to said presser-foot and extending in an upward direction therefrom and wherein said means for slidably holding said presser-foot assembly comprises means for slidably receiving said shaft, said receiving means being affixed to said needle bar.

3. The apparatus of claim 2 wherein said means for biasing said presser-foot assembly comprises:

a spring having a stationary end which does not move relative to the reciprocating needle bar.

4. The apparatus of claim 3 wherein said means for biasing said presser-foot assembly furthermore comprises:

means for supporting said spring at the top of said shaft connected to said presser-foot.

5. The apparatus of claim 4 further comprising:

means, located below said means for supporting said spring, for absorbing the impact caused by said means for slidably holding said presser-foot assembly moving upwardly.

6. The apparatus of claim 1 wherein the toe of the presser-foot normally encompasses the end of a needle when the needle is withdrawn from the workpiece, said apparatus further comprising:

means for manually raising the presser-foot upwardly to an elevated position;

means for latching the presser-foot at the elevated position so as to expose the end of the needle.

7. The apparatus of claim 1 wherein said means for biasing said presser-foot assembly comprises:

a pressurized chamber having means for exerting a biasing force on said presser-foot assembly.

8. The apparatus of claim 7 wherein said pressurized chamber comprises:

a first vessel connected to said means for slidably holding said presser-foot assembly;

a second vessel slidably engaging a surface of said first vessel so as to thereby define a sealed chamber; and means for pressurizing the sealed chamber defined by said first and second vessels.

9. The apparatus of claim 8 wherein said second vessel is mounted to a stationary point which does not move relative to the reciprocating needle bar.

10. The apparatus of claim 8 wherein said presser-foot assembly comprises:

means, connected to said presser-foot and extending upwardly into said sealed chamber for engaging the inner wall of said first vessel so as to thereby define a sealed relationship therewith, whereby relative movement of said second vessel continues to define a pressurized chamber upstream thereof.

11. In a sewing machine having at least one reciprocating needle bar and a needle associated therewith, apparatus for pressing against the workpiece that is to be sewn, said apparatus comprising:

a presser-foot assembly including a presser-foot;

means for biasing said presser-foot towards the workpiece, said biasing means being independently attached to a stationary portion of the sewing machine; and means, connected to said needle bar and slidably engaging said presser-foot assembly for lifting said presser-foot assembly upwardly against the biasing force of said biasing means.

12. The apparatus of claim 11 wherein said presser-foot assembly comprises:

a shaft extending upwardly from said presser-foot, said shaft transmitting the biasing force produced by said biasing means to said presser-foot; and wherein said means for lifting said presser-foot assembly comprises means, connected to said needle bar, for guiding said shaft.

13. The apparatus of claim 12 wherein said means for lifting said presser-foot assembly further comprises:

means, located at the top of said shaft, for engaging said means for guiding said shaft when moving upwardly relative to said shaft.

14. The apparatus of claim 12 wherein said means for guiding said shaft comprises:

means, extending vertically upwardly, for defining a vertical guide path for said shaft; and means, connected to said reciprocating needle bar and extending outwardly therefrom, for mounting said vertically extending means for defining a vertical guide path.

15. The apparatus of claim 14 further comprising:

a leaf spring attached to the end of said presser-foot and extending upwardly therefrom, said leaf spring having a slotted hole therein; and a pin extending outwardly from said mounting means, said pin being aligned with the upward movement of said slotted hole so as to allow for engagement with said slotted hole when the presser-foot is sufficiently above the end of the needle so as to allow for a threading of the needle.

16. In a sewing machine, apparatus for maintaining a steady unvarying pressure against the workpiece during needle engagement with the workpiece, said apparatus comprising:

means for contacting the workpiece that is to be sewn;

means, connected to a reciprocating needle bar of said sewing machine, for slidably holding said means for contacting the workpiece that is to be sewn; and means, connected to a stationary portion of said sewing machine, for biasing said means for contacting the workpiece against said holding means when there is no contact with the workpiece by said contacting means and thereafter against the workpiece when there is contact with the workpiece by said contacting means, whereby a steady unvarying pressure is exerted against the workpiece during needle engagement with the workpiece.

17. The apparatus of claim 16 wherein said means for biasing comprises:

a spring mounted to a stationary point which does not move relative to the reciprocating needle bar; and means, extending through said holding means, for connecting said spring to said means for contacting the workpiece.

18. The apparatus of claim 16 wherein said means for biasing comprises:

a pressurized chamber for producing a biasing force; and means, extending through said holding means, for transmitting the biasing force produced by said pressurized chamber to said means for contacting the workpiece.

19. The apparatus of claim 18 wherein said pressurized chamber is mounted to a stationary point which does not move relative to the reciprocating needle bar.

20. The apparatus of claim 19 further comprising:

means for manually raising said means for contacting the workpiece against the biasing force produced by said pressurized chamber; and means for latching said means for contacting the workpiece at an elevated position so as to expose a sewing needle for threading.

* * * * *